United States Patent [19]

Mino et al.

[11] 4,321,309

[45] Mar. 23, 1982

[54] HEAT-SENSITIVE RECORDING MATERIAL

[75] Inventors: Hisashi Mino; Masao Matsukawa; Minematsu Nagashima, all of Higashimatsuyama, Japan

[73] Assignee: Sanyo-Kokusaku Pulp Co., Ltd., Tokyo, Japan

[21] Appl. No.: 153,416

[22] Filed: May 27, 1980

[30] Foreign Application Priority Data

Jun. 1, 1979 [JP] Japan ..... 54/67425

[51] Int. Cl.[3] ..... B41M 5/18

[52] U.S. Cl. ..... 428/522; 106/26; 282/27.5; 427/150; 427/151; 428/514; 428/532; 428/533; 428/535; 428/913; 428/914; 430/348

[58] Field of Search ..... 282/27.5; 106/21, 26; 427/150, 151; 428/307, 323, 411, 514, 522, 532–535, 537, 913, 914; 430/348

[56] References Cited

U.S. PATENT DOCUMENTS

| | | | |
|---|---|---|---|
| 3,451,338 | 6/1969 | Baum | 430/541 |
| 3,539,375 | 11/1970 | Baum | 117/36.2 |
| 3,846,153 | 11/1974 | Futaki | 428/524 |
| 3,859,112 | 1/1975 | Kohmura | 430/345 |

FOREIGN PATENT DOCUMENTS

| | | | |
|---|---|---|---|
| 45-14039 | 11/1970 | Japan | 282/27.5 |
| 49-69 | 5/1974 | Japan | 428/914 |
| 49-16506 | 8/1974 | Japan | 428/914 |

*Primary Examiner*—Bruce H. Hess

*Attorney, Agent, or Firm*—Oblon, Fisher, Spivak, McClelland & Maier

[57] ABSTRACT

A heat-sensitive recording material having a heat-sensitive layer composed mainly of a leuco dye and a phenolic compound used as a developer, said heat-sensitive layer containing as a binding agent any one or combinations of polyvinyl alcohol, oxidized starch and etherized starch, and methyl cellulose in a ratio by weight between 98:2 and 90:10.

1 Claim, No Drawings

HEAT-SENSITIVE RECORDING MATERIAL

BACKGROUND OF THE INVENTION

The present invention relates to a heat-sensitive recording material which makes a record of various types of information by thermal means.

In certain types of information equipments such as facsimilies, printers, recorders or the like, a system that a record is made of information by thermal means has been developed in recent years. Keeping in step with the advent of such a system, it has been proposed to make use of a variety of heat-sensitive recording materials. Among others, noteworthy is now a heat-sensitive recording material comprising a carrier or substrate having thereon a heat-sensitive layer composed mainly of a leuco dye that is colorless in a normal state and a developer such as a phenolic compound.

The article "Berichte der deutschen chemisehen Gesellschaft" by O. Fisher, F. Romer et al., 42.2934 (1909) already describes that a reaction between a chromogenic leuco dye, e.g., crystal violet lactone and a phenolic compound results in color development. The color development caused by thermal means is also known from, for example, U.S. Pat. No. 3,539,375 and Japanese Patent Publication No. 14039/1970 specifications.

In the above-mentioned type of heat-sensitive recording materials, a binding agent generally takes an important role in addition to a color-forming component. Usually, the heat-sensitive recording materials are prepared by dispersing individually a leuco dye serving as a color former and a developer in separate aqueous medium containing a water-soluble resin acting as a binding agent by a variety of dispersing means such as ball mills, sand grinders or the like for fine pulverization thereof, mixing together the resulting dispersions, and applying the mixture on a carrier followed by drying. The binding agent used to this end should possess the properties as discussed below:

(1) it is readily dispersed; in other words, it suffers neither interaction with the color former nor aggregation, and does not produce a large amount of foams;

(2) upon dispersion, any coloring, aggregation and viscosity rises of the liquid are not observed in admixing of both components; and after coating and drying, (3) the resulting film has a great strength;

(4) no primary color development takes place;

(5) it excels in the color-forming properties, possesses a good thermal conductivity and is free from any desensitization; and (6) it is free from any sticking and deposition, and displays a good matching with respect to a thermal head.

As the binding agent, use has heretofore been made of water-soluble polymeric compounds such as polyvinyl alcohol, (modified) starch or its derivatives, methyl cellulose, hydroxylethyl cellulose, carboxylmethyl cellulose, gum arabic, gelatin, casein, polyvinyl pyrolidone, polyacryl amide, polyacrylate, copolymers of styrene and maleic anhydride, copolymers of isobutylene and maleic anhydride etc., and polymeric latexes or emulsions such as copolymers of styrene and butadiene, polyvinyl acetate, polyacrylic ester etc. However, no binding agent which meets all the foregoing requirements as such has been found as yet. For example, the methyl cellulose, hydroxyethyl cellulose and carboxylmethyl cellulose are disadvantageous in that they are poor in the application and dispersing properties or the color-forming properties upon coating. This is because they have a high viscosity at a low conentration, so that the resulting dispersion is of a high viscosity. The polyvinyl pyrolidone and most of other thermoplastic resins have a softening point of no more than 200° C. and inferior in the heat resistance, so that undesirable sticking is apt to take place at a thermal head.

The latexes or emulsions are also unpreferable since they are unsatisfactory in the dispersing properties upon dispersion, so that the primary color development is readily caused under the influence of certain emulsifiers contained therein. Moreover, the gum arabic, gelatin, casein or the like have various diadvantages such as occurrence of the primary color development and sticking.

Although the polyvinyl alcohols or modified starch such as oxidized or etherized starch appear to be most preferable binding agents in view of the aforesaid requirements, there is still room for improvements in respect of the primary color development.

As a consequence of extensive investigations and studies, it has now been found that a binding agent comprising two through four components selected from the group consisting of any one or combinations of polyvinyl alcohol, oxidized starch and etherized starch, and methyl cellulose in a ratio by weight between 98:2 and 90:10 meets all the aforesaid requirements, and is thus of extremely high quality. More specifically, it has been found that the binding agent comprising a mixture of any one or combinations of polyvinyl alcohol, oxidized starch and etherized starch with methyl cellulose in the above-mentioned weight ratio does not only comply with the requirements 1, 2, 3 and 6, but also provides a heat-sensitive recording material which suffers no primary color development, displays a brightness close to that of natural paper and is excellent in the color development.

SUMMARY OF THE INVENTION

It is a main object of the present invention to provide a heat-sensitive recording material having a heat-sensitive layer composed mainly of a leuco dye and a phenolic compound used as a developer, said heat-sensitive layer containing as a binding agent any one or combinations of polyvinyl alcohol, oxidized starch and etherized starch, and methyl cellulose in a ratio by weight between 98.2 and 90:10.

DETAILED DESCRIPTION OF THE INVENTION

The above-mentioned object and other objects and advantages of the present invention will become apparent to those skilled in the art upon reference to the following detailed description.

The polyvinyl alcohol used as one of the main components of the binding agent according to the present invention may be commercially available and have a polymerization degree of 300–2500 and a saponification value of 80–100 mol %. As the oxidized or etherized starch, one may use a variety of products which are commercially available for coated paper.

More preferably, the ratio of methyl cellulose relative to the total weight of the binding agent is such that it is added in a range of 98:2–90:10 relative to one or more of polyviny alcohol, oxidized starch and etherized starch. In a ratio less than the lower limit of 2%, the methyl cellulose has no effect on the suppression of the primary color development, whereas in a ratio exceeding the upper limit of 10%, the color-forming function drops sharply resulting in decreases in sensitivity.

In what follows, the present invention will be elucidated further.

The leuco dyes used in the present invention may be leuco substances based on triphenylmethane, fluoran, phenothiazine, auramine and spiropyrane, and include for example 3,3-bis(p-dimethylamonophenyl)-6-dimethylaminophthalide (CVL) which is colorless or slightly colored in a normal state, 3,3-bis(p-dibutylaminophenyl) phthalide(malachite green lactone), 3-dimethylamino-6-methoxyfluoran, 3-diemthylamino-6-methyl-7-chlorofluoran, 3-dimethylamino-5-methyl-7-dibenzylaminofluoran, 3-diethylamino-7-methoxyfluoran, 3-diethylamino-7-methylaminofluoran, 3-diethylamino-7-dibenzylaminofluoran, 3-diethylamino-7-(N-methylanilino) fluoran, 3-diethylamino-7-orthochloroanilinofluoran, 3-diethyamino-7,8-benzofluoran, 3-diethylamino-6-methyl-7-chlorofluoran, 3-diethylamino-6-methyl-7-anilinofluoran, 3-diethylamino-6-methyl-7-p-butylanilinofluoran, 3-diethylamino-5-methyl-7-dibenzylaminofluoran, 3-morpholino-5,6-benzofluoran, 3-ethyl-6-methyl-7-anilinofluoran, 2-anilino-6-diethylaminofluoran, 3-(N-methyl-N-cyclohexylamino)-6-methyl-7-anilinofluoran, benzoyl leuco methylene blue, N-phenyl rhodamine beta lactam, amido rhodamine beta saltone, benzo-beta-naphthospiro-pyrane, 1,3,3-trimethyl-6'-chloro-8'-methoxy-indolinobenzospiropyrane and the like.

The phenolic compounds used in the present invention may be liquefied or gasified at a temperature higher than normal temperature, preferably higher than 70° C. and be allowed to react with the chromogenic dyes for color development, and includes for example 4,4'-isopropylidene diphenol (bisphenol A), 4,4'-isoprophylidene bis(2-chlorophenol), 4,4'-isopropylidene bis(2-methylphenol), 4,4'-isopropylidene bis(2-tert. butylphenol), 4,4'-sec. butylidene-diphenol, 4,4'-cyclohexylidene diphenol, 4-tert. butylphenol, 4-tert. octylphenol, 4-tert. octyl catechol, 4-phenylphenol (p-phenylphenol), 4-hydroxy-diphenoxide, 2,2'-dihydroxydiphenol, alpha-naphthol, beta-naphthol, methyl-4-hydroxy benzoate, 4-hydroxy-acetophenol, novolak type phenol resin, halogenated novolak type phenol resin and other phenol polymers. Like the leuco dyes, however, the present invention is not restricted to the above-exemplified compounds.

The heat-sensitive recording layer according to the present invention may contain the following various substances if required, in addition to the above-mentioned leuco dyes, phenolic compound and binding agent. For example, white pigments such as talc, clay, silica and/or titanium oxide are added for further improvements in the ink-receptible properties, the brightness and the sticking; various types of heat-fusible substances such as waxes, metal salts of higher aliphatic acids and/or amides of higher aliphatic acids for prevention of color development under pressures; and dispersing, wetting and/or anti-foaming agents for further improvements in the dispersibility and the coating properties. In another application of the heat-sensitive recoring layer that strongly requires waterproofness, cross-linking agents such as formalin, glyoxal, chrome alum or glutaric aldehyde may also be used to render it waterproof.

In the present invention, any sheet material of a plastic film or the like may be used for the carrier or substrate, to say nothing of sheets of paper.

The present invention will further be explained by the non-restrictive examples given below.

EXAMPLE 1

| | |
|---|---|
| Liquid A | |
| Crystal violet lactone | 20 g |
| 10% aqueous solution of etherized starch (Unique Gum C-3010 manufactured by Matsutani Kagaku K.K.) | 50 g |
| Water | 30 g |

| | |
|---|---|
| Liquid B | |
| Bisphenol A | 10 g |
| Calcium corbonate | 20 g |
| 10% aqueous solution of etherized starch | 30 g |
| Water | 40 g |

Each of liquids A and B is separately added with 100 g of glass beads and is dispersed in a laboratory mixer for two hours. Thereupon, 10 g of liquid A and 80 g of liquid B are well mixed together, after which to the resultant mixture are added 60 g of a 20% aqueous solution of etherized starch (Unique Gum C-3010) and a given amount of a 5% aqueous solution of methyl cellulose (Marporose M-25 manufactured by Matsumoto Yushi K.K.), said amount being specified later, thereby to prepare a heat-sensitive coating liquid. This liquid is applied on a sheet of general-purpose paper having a weight of 50 g/m$^2$ by a Mayer bar such that the amount thereof is 10 g/m$^2$ upon drying, and is then dried for two minutes by a blow mixer maintained at 55° C. to obtain a heat-sensitive recording sheet. The results are summarized in Table 1.

TABLE 1

| Test No. | | Brightness in % | Degree of Color Devel. | Estimation |
|---|---|---|---|---|
| I | (control) | 72.3 | 1.22 | X |
| II | (control) | 73.5 | 1.25 | X |
| III | | 79.2 | 1.27 | O |
| IV | | 79.4 | 1.27 | O |
| V | | 80.4 | 1.25 | O |
| VI | (control) | 80.0 | 1.08 | X |

| Test No. | Amount of Methyl Cellulose Added to the Total Weight of binding agent in wt. % |
|---|---|
| I | 0 |
| II | 1 |
| III | 2 |
| IV | 5 |
| V | 10 |
| VI | 20 |

It is evident from Table 1 that, when the amount of methyl cellulose is in a range of 2 to 10% by weight, both the brightness and the degree of color development are satisfactory. However, the brightness is low in an amount less than the lower limit, while the degree of color development is markedly low in an amount larger than the upper limit.

EXAMPLE 2

| | |
|---|---|
| Liquid A | |
| PSD-170 (manufactured by Shin-Nisso K.K.) | 20 g |

-continued

| | |
|---|---|
| 10% aqueous solution of polyvinyl alcohol (PVA-117 manufactured by Kurare K.K.) | 50 g |
| Water | 30 g |

| | |
|---|---|
| Liquid B | |
| Bisphenol A | 10 g |
| Talc | 20 g |
| Amide stearate | 6 g |
| 10% aqueous solution of polyvinyl alcohol (PVA-117 manufactured by Kurare K.K.) | 30 g |
| Water | 34 g |

Each of liquids A and B is separately added with 100 g of glass beads, and is dispersed in a laboratory mixer for two hours. Thereupon, 8 g of liquid A and 80 g of liquid B are well mixed together, after which to the resultant mixture are added 60 g of a 20% aqueous solution of oxidized starch (Amicoat 800 manufactured by Matsutani Kagaku K.K.) and a 5% aqueous solution of the same methyl cellulose (Marposose M-25 manufactured by Matsumoto Yushi K.K.) as in Ex. 1 in the same amount, thereby preparing a heat-sensitive coating liquid. This liquid is applied and dried in the same manner as in Ex. 1, so that a heat-sensitive recording sheet is obtained. The results are summarized in Table 2.

It is found that, when the amount of methyl cellulose is in a range of 2 to 10% by weight, both the brightness and the degree of color development are satisfactory. However, in an amount less than the lower limit, the brightness is low while, in an amount exceeding the upper limit, the degree of color development is markedly low.

TABLE 2

| | Test No. | Brightness in % | Degree of Color Devel. | Estimation |
|---|---|---|---|---|
| I | (control) | 64.5 | 1.28 | X |
| II | (control) | 65.3 | 1.30 | X |
| II | | 71.8 | 1.30 | O |
| IV | | 72.7 | 1.27 | O |
| V | | 74.4 | 1.28 | O |
| VI | (control) | 75.7 | 1.05 | X |

EXAMPLE 3

A similar heat-sensitive recording sheet is prepared in the same manner as in Ex. 1, except that the etherized starch is substituted by polyvinyl alcohol. The results are identical with those of Examples 1 and 2.

In the foregoing examples, the brightness is measured according to JIS-P 8123 method. The degree of color development is expressed by a value determined on a Macbeth reflection densiometer (type RD-514) in respect of a sample which is subjected to color development at 150° C. and 3 Kg/cm$^2$ for one second in a stamp type color-forming device.

What is claimed is:

1. A heat-sensitive recording material having a heat-sensitive layer comprising a leuco dye and a phenolic compound used as a developer, said heat-sensitive layer containing as a binding agent methyl cellulose and at least one of polyvinyl alcohol, oxidized starch and etherized starch, wherein the weight ratio of methyl cellulose relative to the total amount of binding agent is between 2:98 and 10:90.

* * * * *